US007331355B2

(12) United States Patent
Barnabas et al.

(10) Patent No.: US 7,331,355 B2
(45) Date of Patent: Feb. 19, 2008

(54) FLOOR CLEANING AND GLOSS ENHANCING COMPOSITIONS

(75) Inventors: Mary Vjarayani Barnabas, West Chester, OH (US); Cynthia Elaine Cella, Fairfield, OH (US); Beth Hansell Statt, Lebanon, OH (US); James Thomas Sullivan, Cincinnati, OH (US); Alan Edward Sherry, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 370 days.

(21) Appl. No.: 10/958,851

(22) Filed: Oct. 5, 2004

(65) Prior Publication Data

US 2005/0096239 A1 May 5, 2005

Related U.S. Application Data

(60) Provisional application No. 60/515,852, filed on Oct. 30, 2003.

(51) Int. Cl.
*B08B 3/04* (2006.01)
*C11D 3/37* (2006.01)
*C11D 1/00* (2006.01)

(52) U.S. Cl. ..... 134/25.2; 134/39; 134/40; 134/42; 510/214; 510/217; 510/470; 510/473; 510/474; 510/475

(58) Field of Classification Search ..... 510/214, 510/217, 470, 473, 474, 475; 134/25.2, 39, 134/40, 42
See application file for complete search history.

(56) References Cited

U.S. PATENT DOCUMENTS

| | | | | |
|---|---|---|---|---|
| 4,725,319 | A * | 2/1988 | Osberghaus | 134/4 |
| 4,869,934 | A * | 9/1989 | Jethwa | 427/393.5 |
| 5,409,639 | A | 4/1995 | Fusiak et al. | |
| 5,753,604 | A | 5/1998 | Soldanski et al. | |
| 2003/0083224 | A1* | 5/2003 | Wick et al. | 510/499 |
| 2003/0186832 | A1 | 10/2003 | Pardron et al. | |

FOREIGN PATENT DOCUMENTS

| | | |
|---|---|---|
| DE | 2522 091 | 5/1974 |

* cited by examiner

*Primary Examiner*—Brian Mruk
(74) *Attorney, Agent, or Firm*—Brent M. Peebles; Mark A. Charles; Amy I. Ahn-Roll

(57) ABSTRACT

The present invention relates to compositions for cleaning floors. In particular, it relates to aqueous compositions for one-step cleaning and gloss enhancement of wood surfaces, especially floors. The inventive compositions comprise specific levels of a class of copolymer, chitosan, or mixtures thereof, and specific levels of surfactant. The cleaning benefits are delivered every time the compositions are used; the gloss benefits are provided over three to four cleanings and are easily strippable.

23 Claims, No Drawings

FLOOR CLEANING AND GLOSS ENHANCING COMPOSITIONS

CROSS REFERENCE TO RELATED APPLICATION

This application claims the benefit of U.S. Provisional Application Ser. No. 60/515,852, filed on Oct. 30, 2003.

FIELD OF THE INVENTION

The present invention relates to compositions for cleaning and gloss enhancement of floors. In particular, it relates to aqueous compositions for cleaning and gloss enhancement of wood surfaces, especially wooden floors.

BACKGROUND OF THE INVENTION

Gloss-enhancing floor care compositions are well known in the art and in commercial markets. Many of these compositions comprise cross-linked polyacrylates, and are marketed as gloss-enhancing treatments or polishes. The compositions are applied to the floor, which is then buffed either by using large and expensive buffing or polishing machines, or manually using a cloth, sponge or any other suitable means known in the art for buffing or polishing. In the latter situation, the person typically needs to kneel, has to apply the product by hand, and perform several buffing or polishing steps in order to obtain the desired gloss result.

Once applied, these compositions leave a coating of the polymer on the floor, which is semi-durable and becomes soiled over time and, thus needs to be removed before reapplication. In order to remove the coating, one or more stripping and cleaning treatments are required, often including ammonia. Additionally, most commercial gloss treatments are used as polishes alone, and do not provide any cleaning benefit. In conclusion, gloss polishes are cumbersome and inconvenient as in-home floor care products.

To provide the desired consumer experience, floor cleaning compositions preferably need to both clean and gloss. This is a challenge as the cleaning and gloss enhancement agents must be fully compatible. Moreover the gloss enhancement agent must be chosen to be easily strippable, more preferably be self-strippable, so as to prevent build-up over time which results in a visible residue. By "self-strippable", it is meant that, upon repeated use of the cleaning composition containing the gloss-enhancing agent, the composition removes, at least partially, the coating formed during earlier use, and a new coating is formed. A self-stripping composition can be easily and completely removed by an identical composition that lacks the gloss-enhancing agent. Care must also be exercised to ensure that the properties of the composition, once deposited on the floor, do not change as a result of external factors, including temperature and relative humidity, often leading to stickiness or dullness of the surface.

Floor care is particularly important in the case of wood, for which conventional aqueous cleaning products and methods (e.g., mop-and-bucket) are known to induce swelling and contraction of the wood surfaces leading to unsightly warping and cracking of the wood over time. As such, when aqueous compositions are applied to wood floors, they must be quickly dried to prevent damage.

Aqueous cleaning compositions for enhancing floor surface gloss are known in the art. U.S. Pat. No. 5,753,604 discloses a floor cleaning composition in the form of a dispersion that incorporates a high molecular weight copolymer and a lower molecular weight copolymer. WO 95/00611 discloses a cleaning composition for hardwood floors comprising an alkyl pyrrolidone surfactant and a vinyl pyrrolidone gloss copolymer. European Patent No. 0 215 451 discloses a floor cleaning composition comprising 0.5%-10% surfactant and 0.1%-4.5% of an alkali soluble, non-metal cross-linked polymer having a minimum film-forming temperature of 0° C. to 70° C. and 0.01% to 5% by weight of complexing agents showing an alkaline reaction. U.S. Patent Application No. 2003/0099570 discloses compositions containing polymeric biguanides that clean and enhance floor tile gloss. JP 2001/131495 discloses the use of 3-8% acrylic resin for cleaning floors and faster drying times without loss in gloss. U.S. Pat. No. 4,869,934 discloses floor polishing and coating compositions consisting essentially of 1% to 13% styrene-acrylic copolymer with a weight ratio of monomers from about 2:1 to about 3:1, a second copolymer consisting of interpolymerized (meth)acrylate-(meth)alkyl acrylate groups, fugitive and permanent plasticizers, ammonia and other minors. The compositions clean and provide gloss to floors and the coating is easily removable with household ammonia and detergents. However, these compositions suffer from one or more of the problems described above, e.g., leaving residue on the floor, or require additional steps, including the use of irritating chemicals such as ammonia, to remove the coating, or are not self-strippable.

It is therefore an object of this invention to provide an aqueous floor cleaning composition that enhances surface appearance gloss, especially for wood surfaces, without leaving residue. It is another object of this invention to provide a gloss-enhancing aqueous floor cleaning composition that is self-strippable. It is another object of this invention to provide a composition that enhances aqueous solution drying time, thus minimizing the deleterious effects associated with water-induced wood swelling. It is yet another object of this invention to provide an aqueous composition that does not leave a tacky or streaky residue, and is not susceptible to increased stickiness or dullness at varying temperature and humidity conditions. It is yet a further object of this invention to provide an aqueous cleaning composition that will protect wood surfaces upon repeated use of the composition.

Surprisingly, it has now been found that these and other objectives can be achieved using the composition disclosed herein. The inventive composition does not require the use of plasticizers and can be used in combination with conventional cleaning tools, such as rags, sponges, strips mops, and the like. The composition of the present invention can also advantageously be used in combination with disposable absorbent cleaning pads, especially absorbent cleaning pads comprising superabsorbent polymer. It can also be used as a composition embedded in pre-moistened wipes or pads.

SUMMARY OF THE INVENTION

The present invention relates to an aqueous floor cleaning composition for enhancing the gloss of wooden floor surfaces, characterized in that said composition comprises:

a) at least one polymer selected from:

1. a copolymer comprising a first and a second set of monomer units, said first set of monomer units being selected from the group consisting of acrylate, substituted acrylate monomers, and mixtures thereof, and said second set of monomers being selected from the group consisting of styrene, substituted styrene monomers, and mixtures thereof, said copolymer having a weight ratio of the first set of monomers to the second set of monomers from about 3:1 to about 1:3, said copolymer having an average molecular weight of less than about 20,000, said copolymer being present in the composition at a level of about 0.01% to about 1.0% by weight of the composition; or 2. chitosan having an average molecular weight from about 5,000 to about 500,000, said chitosan being present in the composition at a level of about 0.01% to about 1.0% by weight of the composition; or 3. mixtures thereof; and b) from about 0.005% to about 0.5%, by weight of the composition, of one or more surfactants.

The composition according to the present invention is preferably self-strippable.

DETAILED DESCRIPTION OF THE INVENTION

Definitions

All ratios and percentages are on a weight basis unless otherwise specified.

By 'aqueous cleaning compositions', it is meant cleaning compositions that include at least about 80%, more preferably at least about 85%, still more preferably at least about 90%, and most preferably at least about 95% aqueous chemicals on a ready-to-use basis. As used herein, aqueous chemicals consist of water and solvents that are soluble in water at all proportions. Examples of such aqueous solvents include methanol, ethanol and 2-propanol. Those skilled in the art will recognize that concentrates of the ready-to-use compositions of this invention can be made and then diluted according to usage instructions at the point of use.

By 'absorbent' it is meant any nonwoven material or laminate that can absorb at least about 1 gram of de-ionized water per gram of said material. By 'disposable absorbent cleaning pad' it is meant an absorbent pad that is typically used for a cleaning job and then disposed of. Absorbent disposable cleaning pads can range from simple dry absorbent non-woven structures to multi-layered absorbent composites. While it is understood that some pad designs can be used, stored and re-used, the amount of re-use is limited and is typically determined by the ability of the pad to continue to absorb more liquid and/or soil. Unlike conventional systems such as sponge mops, strip and string mops, which are considered fully re-usable, once saturated, an absorbent disposable pad can not easily be reversed by the consumer to get it back to its original state.

By 'superabsorbent material', it is meant any material lodged inside or on an absorbent disposable pad, that effectively traps and locks water and water-based solutions, effectively removing water or water-based solutions from the floor thereby mitigating known side effects which water has on wood. Superabsorbent materials are typically high molecular weight polyacrylate polymers that can gel upon acquisition of large amounts of aqueous media. Superabsorbent materials are also beneficial when used in combination with the compositions of the present invention because they help keep the floor side of the pad free of water, and significantly enhance the water or aqueous chemistry capacity of the absorbent disposable cleaning pad.

As used herein, 'wood' surfaces consists of any surface that comprises wood or wood veneer to which cleaning compositions are applied. The wood surfaces can be from any tree source or combination of tree sources, such as oak, pine, maple, cherry, beech, birch, cypress, teak, and the like. Wood surfaces can consist of solid wood, acrylic impregnated wood, engineered wood, or parquet wood. The wood surfaces can have a matt, semi-gloss, satin sheen or high gloss appearance. The inventive compositions herein are effective for use on all these surfaces, but are especially effective on wood surfaces with semi-gloss or satin sheen. More moderate, though still significant gloss enhancement benefits are achieved on matt and high gloss surfaces. For wear and tear resistance and sheen maintenance, most modem wood flooring is coated with polyurethane. Any urethane can be used. For example, the urethane can be oil based, water based, or moisture-cured. The inventive compositions can also provide gloss enhancement benefits to these polyurethane coated surfaces. Finally, the compositions of the present invention can be used for the cleaning of wood furniture.

The Copolymer—The copolymers of the present invention provide gloss enhancement and comprise two sets of monomers, or groups of monomers, that are chemically bonded together. The first set of monomers includes acrylates, substituted acrylates, and mixtures thereof, with the chemical structure:

$$—CH_2—C(R_1)—C(O)OR_2,$$

wherein $R_1$=H or $CH_3$ and $R_2$=Li, Na, K or a $C_1$-$C_6$ aliphatic hydrocarbon chain. Examples of acrylates and substituted acrylates include sodium acrylate, sodium methacrylate, potassium ethyl acrylate and potassium butyl methacrylate. Most preferred are sodium acrylate and sodium methacrylate.

The second set of monomers is selected from the group consisting of styrene, substituted styrenes, and mixtures thereof, having the chemical structure $—CH_2—CR_1(C_6H_4R_2)$, wherein $R_1$=H or $CH_3$ and $R_2$=H, $CH_3$, $C_2H_5$ or $SO_3Na$, $SO_3K$. Most preferred are styrene and α-methyl styrene.

Low levels of initiator or other components used to polymerize the monomers into copolymer can also be present in the copolymer raw material, and therefore in the aqueous cleaning composition as well. Preferably, the polymerization or process aids comprise no more than about 10%, more preferably no more than about 5%, most preferably no more than about 2% by weight of the copolymer.

Polymerization of monomers to form the copolymers of the invention can be achieved by any method known in the art. The copolymers can consist of block copolymers, alternating monomer types, or anything in between. Useful polymerization processes and methods that are believed to pertinent to the copolymers of the invention are disclosed in U.S. Pat. Nos. 5,122,568, 5,326,843, 5,886,076, 5,789,511, 6,548,752, Great Britain Patent No. 1 107 249, European Patent No. 0 636 687, and U.S. Patent Application No. 2003/0072950.

The level of copolymer in the compositions of the present invention is at least about 0.01%, but no greater than about 1.0% by weight of the total aqueous compositions. Preferably, the level of copolymer is from about 0.1% to about 1.0%, more preferably from about 0.15% to about 0.9%, and most preferably from about 0.2% to about 0.75% by weight of the aqueous composition. Compositions comprising more than about 1.0% copolymer do not provide additional gloss enhancement benefits on floors or leave streaks or dull residue. Additionally, compositions comprising more than about 1.0% copolymer, once deposited on floor surfaces, can cause unacceptable floor stickiness, and this effect is exacerbated at humidity conditions of 60% and higher. A low level of copolymer is also desirable because it provides an economic advantage relative to conventional gloss treatments, and does not interfere with the cleaning ability provided by the remainder of the aqueous cleaning composition.

The weight ratio of acrylate or substituted acrylate to styrene or substituted styrene monomers in the copolymers of the present invention is from about 3:1 to about 1:3. Weight ratios greater than about 3:1 result in copolymer compositions that are excessively hydrophilic, strip too easily and do not provide the desired improvements in gloss upon repeated use. Weight ratios lower than about 1:3 result in polymers that are excessively hydrophobic, have poorer solubility properties and do not effectively enhance gloss. Preferably, the ratio of acrylate to styrene monomers is from about 2:1 to about 1:2, more preferably from about 3:2 to about 2:3; still more preferably from about 4:3 to about 3:4, and most preferably the ratio of acrylate to styrene monomers is about 1:1.

Molecular weight selection for the copolymers of the present invention is important to achieve gloss-enhancing benefits without objectionable residue. Surprisingly, it has been found that only acrylate or substituted acrylate—styrene or substituted styrene copolymers with an average molecular weight of less than about 20,000 provide gloss benefits without significant residue. Above a molecular weight of about 20,000, the copolymers can still provide gloss enhancement but also contribute to floor residue, presumably because the size of the copolymer is large enough so that the residue becomes more easily visible to the human eye. Preferably, the average molecular weight of the copolymer is less than about 15,000, more preferably less than about 10,000, more preferably still, less than about 7,500. In a most preferred embodiment, the average molecular weight of the copolymer is from about 1,500 to about 7,000, more preferably from about 2,000 to about 6,000, most preferably from about 2,500 to about 5,000. Molecular weight as defined herein is measured using Gel Permeation Chromatography (GPC) using a polyacrylic acid standard. In GPC, there is both a mobile phase and a stationary phase. The mobile phase, comprising a solvent and a portion of the polymer, moves past the stationary phase, which through physical or chemical means temporarily retains some portion of the polymer, thus providing a means of separation. Both of these methods depend on distribution coefficients, relating the selective distribution of an analyte between the mobile phase and the stationary phase, where the analyte is the component being analyzed. The GPC approach utilizes columns containing finely divided, porous particles. Polymer molecules that are smaller than the pore sizes in the particles can enter the pores, and therefore have a longer path and longer transit time than larger molecules that cannot enter the pores. Motion in and out of the pores is statistical, being governed by Brownian motion. Thus, the larger molecules elute earlier in the chromatogram, while the smaller molecules elute later. More information on GPC can be found in *Chromatography of Polymers: Characterization by SEC and FFF*, T. Provder (ed.), American Chemical Society, Washington, D.C., 1993.

In a highly preferred embodiment, the copolymer comprises about equal weight (1:1) ratios of acrylate and styrene moieties, and has an average molecular weight of about 3,000. One suitable example of a commercially available copolymer according to the invention is Alcosperse 747®, manufactured and sold by the Alco Chemical, a division of National Starch & Chemical Company (909 Mueller Drive, Chattanooga, Tenn. 37406, USA). Experimentally, it is observed that cleaning benefits are unimpaired by the polymer and that the gloss builds up slowly on the treated surfaces upon continued composition usage. Importantly, the build-up plateaus once a monolayer of copolymer fully covers the flooring surface, including small cracks that can house water. While not wishing to be limited by theory, it is believed that the gradual gloss build up is in part due to the low molecular weight needed to prevent the formation of visible streaks, and to the fact that the polymer is easily strippable. Strip-ability of the copolymers of the present invention can be confirmed by treating a floor that has previously been gloss-enhanced using the compositions of the invention with an identical composition that lacks the copolymer (see experimental section). Over a single cleaning operation, floor gloss is restored to pre-existing levels prior to any composition application.

The Chitosan polymer—Chitosan is a natural biopolymer comprising linked glucosamine-units. As described herein, the term chitosan includes not only the natural polysaccharide obtained deacetylation of chitin (from marine source) or by direct isolation from fungi, but also includes synthetically produced β-1,4-poly-D-glucosamines and derivatives thereof that are isomers or structurally similar to natural chitosan. The chitosan polymers of the invention have substantially protonated glucosamine monomeric units, improving polymer water solubility. The counterions associated with protonated glucosamine units can be any known in the art, for example lactate, acetate, gluconate and the like.

When present, the chitosan level in the compositions of the present invention is from about 0.01% to about 1.0%. More preferably, the level of chitosan polymer is from about 0.01% to about 0.75%, more preferably from about 0.01% to about 0.50%, most preferably from about 0.02% to about 0.40%. Chitosan polymers of the invention have an average molecular weight of between about 5,000 and about 500,000. More preferably, the chitosan polymers have an average molecular weight of between about 5,000 and about 100,000, even more preferably an average molecular weight of between about 5,000 and about 50,000, and most preferably an average molecular weight of between about 5,000 and about 30,000. The use of lower molecular weight chitosans as described above improves composition water solubility and also mitigates residue left on floor. Lower molecular chitosan (i.e., Mw below 100,000 more preferably below 50,000) provides flexibility to increase chitosan concentration (0.10% and beyond) in the compositions of the present invention, improving shine enhancement while delivering drying time benefits; lower molecular chitosan is also easier to strip, ensuring no unwanted build-up on floors. Higher molecular weight (Mw 50,000 to 100,000) provides flexibility for lower chitosan concentrations (below about 0.10%) in the compositions of the present invention. While higher molecular weight chitosan does lead to increased residue, it represents a cost-effective means of delivering significant drying time improvement benefits by providing the benefits at low concentration levels (less than about 0.10%).

Surfactants—The aqueous cleaning compositions of the present invention comprise from about 0.005% to about 0.50% surfactants. Suitable surfactants include nonionic, zwitterionic, amphoteric, anionic or cationic surfactants, having hydrophobic chains containing from about 8 to about 18 carbon atoms. Examples of suitable surfactants are described in McCutcheon's Vol. 1: Emulsifiers and Detergents, North American Ed., McCutcheon Division, MC Publishing Co., 2002. Preferably, the aqueous compositions comprise from about 0.005% to about 0.45%, more preferably from about 0.0075% to about 0.30%, still more preferably from about 0.01% to about 0.20%, and most preferably from about 0.015% to about 0.10% surfactants. The exact level of surfactants in the compositions can depend on a number of factors including surfactant type, class and chain-length, desired level of copolymer and desired level and type of fragrance in the composition. Preferably, the compositions of the present invention are also substantially free of cationic surfactants because they can interfere with the mechanism that provides gloss-enhancing benefits to wood and other floor surfaces. If included, cationic surfactants preferably comprise less than about 0.10%, more preferably less than about 0.05%, still more preferably less than about 0.03%, and most preferably less than about 0.02% by weight of the aqueous cleaning composition. In one preferred embodiment, the compositions comprise from 0.02% to 0.08% surfactant and the compositions are substantially free of cationic surfactant.

Non-ionic surfactants are highly preferred for use in the compositions of the present invention. Non-limiting examples of suitable non-ionic surfactants include alcohol alkoxylates, alkyl polysaccharides, amine oxides, block copolymers of ethylene oxide and propylene oxide, fluoro surfactants and silicon based surfactants. If present, non-ionic surfactants comprise from about 0.001% to about 0.5% by weight of the composition. Preferably, the aqueous compositions comprise from about 0.005% to about 0.40%, more preferably from about 0.0075% to about 0.30%, still more preferably from about 0.01% to about 0.20%, and most preferably from about 0.015% to about 0.10% non-ionic surfactants.

In a highly preferred embodiment, at least one of the non-ionic surfactants used in the present invention is an alkylpolysaccharide. Such preferred surfactants are disclosed in U.S. Pat. Nos. 4,565,647, 5,776,872, 5,883,062, and 5,906,973. Among alkylpolysaccharides, preferred are those comprising five or six carbon sugar rings, more preferred are those comprising six carbon sugar rings, and most preferred are those wherein the six carbon sugar ring is derived from glucose, i.e., alkyl polyglucosides. The alkyl moieties of the polyglucoside can be derived from fats, oils or chemically produced alcohols; the sugar moieties are derived from hydrolyzed polysaccharides. Alkyl polyglucosides are formed from condensation product of fatty alcohol and sugars like glucose with the number of glucose units defining the relative hydrophilicity. The sugar units can additionally be alkoxylated either before or after reaction with the fatty alcohols. Such alkyl polyglycosides are described in detail in WO 86/05199. Technically, alkyl polyglycosides are generally not molecularly uniform products, but represent mixtures of alkyl groups and mixtures of monosaccharides and different oligosaccharides. The average number of glucoside units is preferably from about 1.0 to about 2.0, more preferably from about 1.2 to about 1.8, most preferably from about 1.3 to about 1.7. Alkyl polyglucosides (also sometimes referred to as "APG's") are preferred non-ionics for the purposes of the invention since they are low residue surfactants. The alkyl substituent in the APG chainlength is preferably a saturated or unsaturated alkyl moiety containing from about 8 to about 16 carbon atoms. $C_8$-$C_{16}$ alkyl polyglucosides are commercially available (e.g., Simusol® surfactants from Seppic Corporation, 75 Quai d'Orsay, 75321 Paris, Cedex 7, France, and Glucopon 220®, Glucopon 225®, Glucopon 425®, Plantaren 2000®, Plantaren 2000 N®, and Plantaren 2000 N UP®, available from Cognis Corporation, Postfach 13 01 64, D 40551, Dusseldorf, Germany).

Another class of non-ionic surfactants suitable for the present invention is alkyl ethoxylates. The alkyl ethoxylates of the present invention are either linear or branched, and contain from about 8 carbon atoms to about 16 carbon atoms in the hydrophobic tail, and from about 3 ethylene oxide units to about 20 ethylene oxide units in the hydrophilic head group. Examples of alkyl ethoxylates include Neodol 91-6®, Neodol 91-8® supplied by the Shell Corporation (P.O. Box 2463, 1 Shell Plaza, Houston, Tex.), and Alfonic 810-60® supplied by Condea Corporation, (900 Threadneedle P.O. Box 19029, Houston, Tex.). More preferred surfactants are the alkyl ethoxylates comprising from about 9 to about 12 carbon atoms in the hydrophobic tail, and from about 4 to about 9 ethylene oxide units in the hydrophilic head group. These surfactants offer excellent cleaning benefits and work synergistically with the copolymers of the invention. A most preferred alkyl ethoxylate is $C_{11}EO_5$, available from the Shell Chemical Company under the trademark Neodol 1-5®.

Another class of non-ionic surfactant suitable for the present invention is amine oxide. Amine oxides, particularly those comprising from about 12 carbon atoms to about 16 carbon atoms in the hydrophobic tail, are beneficial because of their strong cleaning profile and effectiveness even at levels below 0.10%. Additionally C12-16 amine oxides are excellent solubilizers of perfume. Alternative non-ionic detergent surfactants for use herein are alkoxylated alcohols generally comprising from about 8 to about 16 carbon atoms in the hydrophobic alkyl chain of the alcohol. Typical alkoxylation groups are propoxy groups or ethoxy groups in combination with propoxy groups, yielding alkyl ethoxy propoxylates. Such compounds are commercially available under the tradename Antarox® available from Rhodia (40 Rue de la Haie-Coq F-93306, Aubervilliers Cedex, France) and under the tradename Nonidet® available from Shell Chemical.

Also suitable for use in the present invention are the fluorinated nonionic surfactants. One particularly suitable fluorinated nonionic surfactant is Fluorad F170 (3M Corporation, 3M Center, St. Paul, Minn., USA). Fluorad F170 has the formula:

$$C_8F_{17}.SO_2N(C_2H_5)(CH_2CH_2O)_x$$

Also suitable for use in the present invention are silicon-based surfactants. One example of these types of surfactants is Silwet L7604 available from Dow Chemical (1691 N. Swede Road, Midland, Mich., USA).

The condensation products of ethylene oxide with a hydrophobic base formed by the condensation of propylene oxide with propylene glycol are also suitable for use herein. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic® surfactants, marketed by BASF. Chemically, such surfactants have the structure $(EO)_x(PO)_y(EO)_z$ or $(PO)_x(EO)_y(PO)_z$ wherein x, y, and z are from about 1 to about 100, preferably about 3 to about 50.

Pluronic® surfactants known to be good wetting surfactants are more preferred. A description of the Pluronic® surfactants, and properties thereof, including wetting properties, can be found in the brochure entitled BASF Performance Chemicals Plutonic® & Tetronic® Surfactants", available from BASF. Other suitable though not preferred non-ionic surfactants include the polyethylene oxide condensates of alkyl phenols, e.g., the condensation products of alkyl phenols having an alkyl group containing from about 6 to about 12 carbon atoms in either a straight chain or branched chain configuration, with ethylene oxide, the said ethylene oxide being present in amounts equal to about 10 to about 25 moles of ethylene oxide per mole of alkyl phenol. The alkyl substituent in such compounds can be derived from oligomerized propylene, diisobutylene, or from other sources of iso-octane n-octane, iso-nonane or n-nonane. Other non-ionic surfactants that can be used include those derived from natural sources such as sugars and include $C_8$-$C_{16}$ N-alkyl glucose amide surfactants.

Zwitterionic surfactants represent a second class of preferred surfactants within the context of the present invention. If present, zwitterionic surfactants comprise from about 0.001% to about 0.5% by weight of the composition. Preferably, the aqueous compositions comprise from about 0.005% to about 0.40%, more preferably from about 0.0075% to about 0.30%, still more preferably from about 0.01% to about 0.20%, and most preferably from about 0.015% to about 0.10% zwitterionic surfactants.

Zwitterionic surfactants contain both cationic and anionic groups on the same molecule over a wide pH range. The typical cationic group is a quaternary ammonium group, although other positively charged groups like sulfonium and phosphonium groups can also be used. The typical anionic groups are carboxylates and sulfonates, preferably sulfonates, although other groups like sulfates, phosphates and the like, can be used. Some common examples of these detergents are described in the patent literature: U.S. Pat. Nos. 2,082,275, 2,702,279 and 2,255,082. A generic formula for some preferred zwitterionic surfactants is:

$$R—N^+(R^2)(R^3)(R^4)X^-,$$

wherein R is a hydrophobic group; $R^2$ and $R^3$ are each a C1-4 alkyl hydroxy alkyl or other substituted alkyl group which can be joined to form ring structures with the N; $R^4$ is a moiety joining the cationic nitrogen to the hydrophilic anionic group, and is typically an alkylene, hydroxy alkylene, or polyalkoxyalkylene containing from one to four carbon atoms; and X is the hydrophilic group, most preferably a sulfonate group. Preferred hydrophobic groups R are alkyl groups containing from about 6 to about 20 carbon atoms, preferably less than about 18 carbon atoms. The hydrophobic moieties can optionally contain sites of unsaturation and/or substituents and/or linking groups such as aryl groups, amido groups, ester groups, etc. A specific example of a "simple" zwitterionic surfactant is 3-(N-dodecyl-N,N-dimethyl)-2-hydroxypropane-1-sulfonate (Lauryl hydroxy sultaine) available from the McIntyre Company (24601 Governors Highway, University Park, Ill. 60466, USA) under the tradename Mackam LHS®. Other specific zwitterionic surfactants have the generic formula:

$$R—C(O)—N(R^2)—(CR^3{}_2)_n—N(R^2)_2{}^+—(CR^3{}_2)_n—SO_3{}^-,$$

wherein each R is a hydrocarbon, e.g., an alkyl group containing from about 6 to about 20, preferably up to about 18, more preferably up to about 16 carbon atoms, each ($R^2$) is either a hydrogen (when attached to the amido nitrogen), short chain alkyl or substituted alkyl containing from about 1 to about 4 carbon atoms, preferably groups selected from the group consisting of methyl, ethyl, propyl, hydroxy substituted ethyl and propyl and mixtures thereof, more preferably methyl, each ($R^3$) is selected from the group consisting of hydrogen and hydroxyl groups, and each n is a number from about 1 to about 4, more preferably about 2 or about 3, most preferably about 3, with no more than about 1 hydroxy group in any ($CR^3{}_2$) moiety. The R group can be linear or branched, saturated or unsaturated. The $R^2$ groups can also be connected to form ring structures. A preferred surfactant of this type is a C12-14 acylamidopropylene (hydroxypropylene) sulfobetaine that is available from McIntyre under the tradename Mackam 50-SB®. Other very useful zwitterionic surfactants include hydrocarbyl, e.g., fatty alkylene betaines. These surfactants tend to become more cationic as pH is lowered due to protonation of the carboxyl anionic group, and in one embodiment have the generic formula:

$$R—N(R^1)_2{}^+—(CR^2{}_2)_n—COO^-,$$

wherein R is a hydrocarbon, e.g., an alkyl group containing from about 6 to about 20, preferably up to about 18, more preferably up to about 16 carbon atoms, each ($R^1$) is a short chain alkyl or substituted alkyl containing from about 1 to about 4 carbon atoms, preferably groups selected from the group consisting of methyl, ethyl, propyl, hydroxy substituted ethyl and propyl and mixtures thereof, more preferably methyl, ($R^2$) is selected from the group consisting of hydrogen and hydroxyl groups, and n is a number from about 1 to about 4, preferably about 1. A highly preferred low residue surfactant of this type is Empigen BB®, a coco dimethyl betaine produced by Albright & Wilson. In another equally preferred embodiment, these betaine surfactants have the generic formula:

$$R—C(O)—N(R^2)—(CR^3{}_2)_n—N(R^2)_2{}^+—(CR^3{}_2)_n—COO^-,$$

wherein each R is a hydrocarbon, e.g., an alkyl group containing from about 6 to about 20, preferably up to about 18, more preferably up to about 16 carbon atoms, each ($R^2$) is either a hydrogen (when attached to the amido nitrogen), short chain alkyl or substituted alkyl containing from about 1 to about 4 carbon atoms, preferably groups selected from the group consisting of methyl, ethyl, propyl, hydroxy substituted ethyl and propyl and mixtures thereof, more preferably methyl, each ($R^3$) is selected from the group consisting of hydrogen and hydroxyl groups, and each n is a number from about 1 to about 4, more preferably about 2 or about 3, most preferably about 3, with no more than about 1 hydroxy group in any ($CR^3{}_2$) moiety. The R group can be linear or branched, saturated or unsaturated. The $R^2$ groups can also be connected to form ring structures. A highly preferred surfactant of this type is Mackam 35HP®, a coco amido propyl betaine produced by McIntyre.

The third class of preferred surfactants comprises the group consisting of amphoteric surfactants. If present, amphoteric surfactants comprise from about 0.001% to about 0.5% by weight of the composition. Preferably, the aqueous compositions comprise from about 0.005% to about 0.40%, more preferably from about 0.0075% to about 0.30%, still more preferably from about 0.01% to about 0.20%, and most preferably from about 0.015% to about 0.10% amphoteric surfactants. These surfactants function essentially as zwitterionic surfactants at acidic pH. One suitable amphoteric surfactant is a C8-C16 amido alkylene glycinate surfactant ('ampho glycinate'). Another suitable amphoteric surfactant is a C8-C16 amido alkylene propionate surfactant ('ampho propionate'). These surfactants have the generic structure:

$$R—C(O)—(CH_2)_n—N(R^1)—(CH_2)_x—COO^-,$$

wherein R—C(O)— is a about C5 to about C15, pre hydrophobic fatty acyl moiety, each n is from about 1 to about 3, each R1 is preferably hydrogen or a C1-C2 alkyl or hydroxyalkyl group, and x is about 1 or about 2. Such surfactants are available, in the salt form, from Goldschmidt chemical under the tradename Rewoteric AM®. Examples of other suitable low residue surfactants include cocoyl amido ethyleneamine-N-(methyl) acetates, cocoyl amido ethyleneamine-N-(hydroxyethyl) acetates, cocoyl amido propyleneamine-N-(hydroxyethyl) acetates, and analogs and mixtures thereof. Other suitable, amphoteric surfactants are represented by surfactants such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol®", and described in U.S. Pat. No. 2,528,378.

Anionic surfactants are also suitable for use within the compositions of the present invention. Anionic surfactants herein typically comprise a hydrophobic chain comprising from about 8 to about 18 carbon atoms, preferably from about 8 to about 16 carbon atoms, and typically include a sulfate, sulfonate or carboxylate hydrophilic head group. If present, the level of anionic surfactant is preferably from about 0.005% to about 0.10%, more preferably from about 0.0075% to about 0.05%, most preferably from about 0.01% to about 0.03%. Anionic surfactants are often useful to help provide good surface end result appearance through a 'toning' effect. By toning effect, it is meant an improvement in the visual appearance of the end result due to less visual floor haziness. While not wishing to be limited by theory, it is believed that the toning effect is obtained by breaking up surfactant system aggregation system on floors that occurs as the aqueous elements in the composition evaporate. One preferred toning effect surfactants are most useful when alcohol ethoxylates are used as primary surfactants in the compositions of the present invention. Preferred toning effect surfactants include octyl sulfonate commercially available from Stepan under the tradename Bio-Terge PAS-8® (22 West Frontage Road, Northfield, Ill. 60093, USA). Another outstanding "toning" surfactant of benefit to the present invention is Luviskol CS-1, which can be purchased from BASF (67056 Ludwigshafen, Germany). If present, the Luviskol CS-1 is preferably used in from about 1:20 to about 1:1 weight ratio with respect to the primary surfactant(s).

Other non-limiting examples of anionic surfactants which suitable for the compositions of the present invention include $C_8$-$C_{18}$ paraffin sulfonates (Hostapur SAS® from Hoechst, Aktiengesellschaft, D-6230 Frankfurt, Germany), $C_{10}$-$C_{14}$ linear or branched alkyl benzene sulfonates, $C_9$-$C_{15}$ alkyl ethoxy carboxylates detergent surfactant (Neodox® surfactants available from Shell Chemical Corporation, P.O. Box 2463, 1 Shell Plaza, Houston, Tex.), $C_{10-14}$ alkyl sulfates and ethoxysulfates (e.g., Stepanol AM® from Stepan). Other important anionics that can be used in compositions of the present invention include sodium or potassium alkyl benzene sulfonates, in which the alkyl group contains from about 9 to about 15 carbon atoms, especially those of the types described in U.S. Pat. Nos. 2,220,099 and 2,477,383.

Composition pH—The compositions of the present invention have a pH range from about 6 to about 11, more preferably from about 6.5 to about 10.5, still more preferably from about 7 to about 10, and most preferably from about 7 to about 9.5. The preferred pH ranges are chosen to maximize the gloss-enhancing properties of the copolymer or chitosan, while mitigating or eliminating filming and streaking negatives due to excessive acidity or alkalinity.

Optional solvents—Solvents lower surface tension properties of the compositions thereby helping wetting and cleaning of floor surfaces. Solvents can also advantageously be used to manipulate the friction between cleaning implement and the floor surface. Finally solvents achieve these cleaning, wetting and friction modifying benefits without contributing residue. As such, the following solvents or mixtures of solvents are optional, though highly preferred components of the compositions of the present invention.

Optional solvents for use herein include all those known in the art for use in hard-surface cleaner compositions. Suitable solvents can be selected from the group consisting of: aliphatic alcohols, ethers and diethers, glycols or alkoxylated glycols, glycol ethers, alkoxylated aromatic alcohols; aromatic alcohols, terpenes, and mixtures thereof. Aliphatic diols and glycol ether solvents are most preferred solvents. If present, solvents are preferably present at levels from about 0.25% to about 10%, more preferably about 0.5% to about 5%, more preferably from about 1% to about 4% by weight of the aqueous cleaning compositions.

Suitable glycols to be used herein are according to the formula $HO—CR_1R_2—OH$ wherein $R_1$ and R2 are independently H or a $C_2$-$C_{10}$ saturated or unsaturated aliphatic hydrocarbon chain and/or cyclic. Suitable glycols to be used herein are 1,2-hexanediol, 2-ethyl-1,3-hexanediol and 1,2-propanediol.

In one preferred embodiment, at least one glycol ether solvent is incorporated in the compositions of the present invention. Preferred glycol ethers have a terminal C3-C6 hydrocarbon attached to either from one to three ethylene glycol moieties or from one to three propylene glycol moieties to provide the appropriate degree of hydrophobicity, wetting and surface activity. Most preferred for use in the compositions of the present invention are glycol ether solvents that comprise either one or two ethylene oxide moieties and a C4-C6 terminal alkyl chain, or a single propylene oxide moiety and a C3-C6 terminal chain. Examples commercially available highly preferred glycol ether solvents include propylene glycol n-propyl ether, propylene glycol n-butyl ether, ethylene glycol n-butyl ether; diethylene glycol n-butyl ether, ethylene glycol n-hexyl ether and diethylene glycol n-hexyl ether, all available from Dow Chemical.

Optional Polymers—The following polymers are highly preferred optional ingredients that can offer additional benefits, including but not limited to, viscosity modification, haze mitigation and particulate soil removal. Of particular interest are the specific polymers or classes of polymers disclosed in European Patent Application No. 1 019 475, European Patent Application 1 216 295, U.S. Pat. No. 6,340,663, U.S. Patent Application No. 2003/0017960, U.S. Patent Application No. 2003/0186830, and WO 01/23510. Non-limiting examples of suitable polymers include naturally occurring polysaccharides such as xanthan gum, guar gum, locust bean gum and synthetic polysaccharides such carboxymethylcellulose, ethyl cellulose, hydroxyethyl cellulose, hydroxypropyl cellulose. Other suitable polymers include those derived from N-vinyl pyrrolidone, including polyvinyl pyrrolidones (10,000 to 200,000 molecular weight) and copolymers formed by reacting N-vinyl pyrrolidone with either acrylic acid, methacrylic acid, itaconic acid, caprolactam, butene or vinyl acetate. Still other suitable polymers comprise sulfonate and amine oxide functionalities, such as polyvinyl pyridine-N-oxide (1,000 to 50,000 molecular weight), polyvinyl sulfonate (1,000 to 10,000 molecular weight), and polyvinyl styrene sulfonate (10,000 to 1,000,000 molecular weight). Yet other classes of suitable polymers include polyethylene glycols (5,000 to 5,000,000 molecular weight), modified polyethylene imines such as Lupasol SK sold by BASF (100,000 to 5,000,000 molecular weight).

Other optional components—The aqueous cleaning compositions according to the present invention may comprise a variety of other optional ingredients depending on the technical benefit aimed for and the surface treated. Suitable optional ingredients for use herein include additional chelants, builders, enzymes buffers, perfumes, hydrotropes, colorants, pigments and/or dyes. In most cases, it is preferable that the level of these components not exceed about 0.50% of the composition.

Polymer cleaning gloss and fast-drying benefits—Though the cleaning mechanism is not fully understood, it is believed that some of the cleaning enhancements are also due to better wetting and floor coverage from the two polymer types described in this invention (styrene-acrylic copolymer type and chitosan polymer type). When the cleaning composition of the present invention is used for the first time, the inventive compositions form a coating on the floor. Because of the low level of the polymer used, and the self-strippable capability of the composition (each time the composition is used, part of the coating is removed, and replaced with a new coating), it requires three to four cleaning operations, for the coating to fully cover the entire floor surface, including small cracks in the surface. At that juncture, the floor gloss reaches a steady state value, meaning that subsequent cleanings do not provide significant incremental gloss enhancement benefits. However, continued application of the inventive compositions can help continually rejuvenate the copolymer coating and can protect the wood surface from the elements. By creating a protective thin film on the wood, the compositions herein help reduce visible imperfections, and can protect even small cracks from additional soil entrainment and from the effects of water, heat and humidity. The substantially uniform, easily strippable layers also reduce surface area of the floors (i.e., the coating 'smooths out' surface effects such as pores and wood grain, effectively reducing the three dimensionality of the wood surface), resulting not only in faster drying times, but also easier and improved soil removal on subsequent cleanings. Though not wishing to be limited by theory, it is also believed that the polymers of the invention lower the contact angle formed by the inventive compositions applied to floor surfaces, mitigating spot formation as the aqueous composition dry down, and that this also contributes to faster drying times relative to identical compositions lacking the copolymer. Faster drying is observed on multiple surface types, including ceramic tile and vinyl. The drying time benefits are particularly significant and important for wood surfaces, particularly grainy wood, delicate wood or worn wood.The styrene-acrylic copolymer of the present invention can also provide a cleaning boost owing to the carboxylate soil-trapping capacity (chelation), and the chitosan polymer can provide cleaning benefits from adsorption of grease or other oil-based soils. The level of shine enhancement is dependent on molecular weight of the polymer, with lower molecular weight polymers preferred, ceteris paribus. In general, the styrene-acrylate copolymers are more effective for gloss enhancement benefits while chitosan polymers are more effective for reducing solution drying time. One skilled in the art will appreciate the advantages of combining the styrene-acrylate copolymer and chitosan polymer into a single cleaning composition, driving overall floor cleaning and shine enhancement while maximizing fast solution drying time.

Finally, the styrene-acrylic copolymers of the invention are shown to provide improved solubility of perfumes, even for very hydrophobic perfumes. As such the copolymer enables use of minimal surfactant levels in a cleaning composition without concern for perfume solubility. As such, the perfume dissolving properties of the copolymer can indirectly translate into reduced filming and streaking, and visual end result benefits.

Methods of use—The aqueous cleaning compositions of the present invention can be applied directly on floors using any methodology known in the art. The compositions can be used neat (i.e., undiluted), or can be further diluted with water prior to use. In one application the compositions are packaged in a bottle or other container as a concentrated product, and are then diluted with water, optionally in a bucket, prior to application on the floor surface. Additionally, they can be used in combination with conventional cleaning implements, pre-moistened wipes, or disposable absorbent cleaning pads as described below.

Cleaning systems—The aqueous cleaning compositions can be used in combination with conventional cleaning tools, such as sponges, cloths, cellulose strings and strips, paper, commercially available paper towels, soft or scouring pads, brushes, and the like. These cleaning tools can optionally be used in combination with an implement for increased ease of use and improved area coverage.

In a preferred embodiment, the aqueous compositions are provided in the form of a "spray and mop" product. In this context, the liquid compositions are packaged in a reservoir (e.g. a bottle) that allows easy dosing directly on floors, preferably by spraying, then wiped by using a conventional mop, a dry nonwoven attached to a cleaning tool, a disposable absorbent pad, disposable absorbent pad further comprising superabsorbent polymer or any other cleaning implement. "Spray and mop" kits may be sold as a combined package comprising lotion and cleaning implement, or as liquid cleaner solution to be used in conjunction with implements or cleaning cloths or pads as desired by individual users. In a particularly preferred embodiment, the cleaning implement comprises a handle, connected to a mop head, whereto an disposable absorbent cleaning pad can be removably attached. The cleaning implement may optionally comprise a liquid delivery system. Examples of such a product are currently sold by the Procter and Gamble Company under the name "Swiffer WETJE®" and "Swiffer Spray&Clean®". In another preferred embodiment, a cleaning implement comprising a handle and a mop head, however without liquid delivery system, may be used in combination with pre-moistened pads.

Disposable absorbent cleaning pads—Disposable absorbent cleaning pads represent a method of cleaning, geared toward achieving outstanding end result. In a preferred embodiment, the disposable absorbent cleaning pads are multi-layered, and comprise an absorbent layer, optionally a scrubbing layer, and optionally an attachment layer. The absorbent layer is the essential component, which serves to retain any fluid and soil absorbed by the cleaning pad during use. The absorbent layer may consist of or comprise fibrous material, including naturally occurring (modified or unmodified), as well as synthetically made fibers. Examples of suitable unmodified/modified naturally occurring fibers include cotton, Esparto grass, bagasse, kemp, flax, silk, wool, wood pulp, chemically modified wood pulp, jute, ethyl cellulose, and cellulose acetate. Suitable synthetic fibers can be made from polyvinyl chloride, polyvinyl fluoride, polytetrafluoroethylene, polyvinylidene chloride, polyacrylics such as ORLON®, polyvinyl acetate, Rayon®, polyethylvinyl acetate, non-soluble or soluble polyvinyl alcohol, polyolefins such as polyethylene (e.g., PULPEX®) and polypropylene, polyamides such as nylon, polyesters such as DACRON® or KODEL®, polyurethanes, polystyrenes, and the like. The absorbent layer can comprise solely naturally occurring fibers, solely synthetic fibers, or any compatible combination thereof. The fibers useful herein can be hydrophilic, hydrophobic or can be a combination thereof. Suitable hydrophilic fibers for use in the present invention include cellulosic fibers, modified cellulosic fibers, rayon, polyester fibers such as hydrophilic nylon (HYDROFIL®). Suitable hydrophilic fibers can also be obtained by hydrophilizing hydrophobic fibers, such as surfactant-treated or silica-treated thermoplastic fibers derived from, for example, polyolefins such as polyethylene or polypropylene, polyacrylics, polyamides, polystyrenes, polyurethanes and the like. Another type of hydrophilic fiber for use in the present invention is chemically stiffened cellulosic fibers. As used herein, the term "chemically stiffened cellulosic fibers" means cellulosic fibers that have been stiffened by chemical means to increase the stiffness of the fibers under both dry and aqueous conditions. Such means can include the addition of a chemical stiffening agent that, for example, coats and/or impregnates the fibers. Such means can also include the stiffening of the fibers by altering the chemical structure, e.g., by crosslinking polymer chains. Where fibers are used as the absorbent layer (or a constituent component thereof), the fibers may optionally be combined with a thermoplastic material. Upon melting, at least a portion of this thermoplastic material migrates to the intersections of the fibers, typically due to interfiber capillary gradients. These intersections become bond sites for the thermoplastic material. When cooled, the thermoplastic materials at these intersections solidify to form the bond sites that hold the matrix or web of fibers together in each of the respective layers. This may be beneficial in providing additional overall integrity to the cleaning pad. Amongst its various effects, bonding at the fiber intersections increases the overall compressive modulus and strength of the resulting thermally bonded member. In the case of the chemically stiffened cellulosic fibers, the melting and migration of the thermoplastic material also has the effect of increasing the average pore size of the resultant web, while maintaining the density and basis weight of the web as originally formed. This can improve the fluid acquisition properties of the thermally bonded web upon initial exposure to fluid, due to improved fluid permeability, and upon subsequent exposure, due to the combined ability of the stiffened fibers to retain their stiffness upon wetting and the ability of the thermoplastic material to remain bonded at the fiber intersections upon wetting and upon wet compression. In net, thermally bonded webs of stiffened fibers retain their original overall volume, but with the volumetric regions previously occupied by the thermoplastic material becoming open to thus increase the average interfiber capillary pore size. Thermoplastic materials useful in the present invention can be in any of a variety of forms including particulates, fibers, or combinations of particulates and fibers. Thermoplastic fibers are a particularly preferred form because of their ability to form numerous interfiber bond sites. Suitable thermoplastic materials can be made from any thermoplastic polymer that can be melted at temperatures that will not extensively damage the fibers that comprise the primary web or matrix of each layer. Preferably, the melting point of this thermoplastic material will be less than about 190° C., and preferably between about 75° C. and about 175° C. In any event, the melting point of this thermoplastic material should be no lower than the temperature at which the thermally bonded absorbent structures, when used in the cleaning pads, are likely to be stored. The melting point of the thermoplastic material is typically no lower than about 50° C. The thermoplastic materials, and in particular the thermoplastic fibers, can be made from a variety of thermoplastic polymers, including polyolefins such as polyethylene (e.g., PULPEX®) and polypropylene, polyesters, copolyesters, polyvinyl acetate, polyethylvinyl acetate, polyvinyl chloride, polyvinylidene chloride, polyacrylics, polyamides, copolyamides, polystyrenes, polyurethanes and copolymers of any of the foregoing such as vinyl chloride/vinyl acetate, and the like. Depending upon the desired characteristics for the resulting thermally bonded absorbent member, suitable thermoplastic materials include hydrophobic fibers that have been made hydrophilic, such as surfactant-treated or silica-treated thermoplastic fibers derived from, for example, polyolefins such as polyethylene or polypropylene, polyacrylics, polyamides, polystyrenes, polyurethanes and the like. The surface of the hydrophobic thermoplastic fiber can be rendered hydrophilic by treatment with a surfactant, such as a nonionic or anionic surfactant, e.g., by spraying the fiber with a surfactant, by dipping the fiber into a surfactant or by including the surfactant as part of the polymer melt in producing the thermoplastic fiber. Upon melting and resolidification, the surfactant will tend to remain at the surfaces of the thermoplastic fiber. Suitable surfactants include nonionic surfactants such as Brij® 76 manufactured by ICI Americas, Inc. of Wilmington, Del., and various surfactants sold under the Pegosperse® trademark by Glyco Chemical, Inc. of Greenwich, Connecticut. These surfactants can be applied to the thermoplastic fibers at levels of, for example, from about 0.2 to about 1 g. per sq. of centimeter of thermoplastic fiber. Suitable thermoplastic fibers can be made from a single polymer (monocomponent fibers), or can be made from more than one polymer (e.g., bicomponent fibers). As used herein, "bicomponent fibers" refers to thermoplastic fibers that comprise a core fiber made from one polymer that is encased within a thermoplastic sheath made from a different polymer. The polymer comprising the sheath often melts at a different, typically lower, temperature than the polymer comprising the core. As a result, these bicomponent fibers provide thermal bonding due to melting of the sheath polymer, while retaining the desirable strength characteristics of the core polymer. Suitable bicomponent fibers for use in the present invention can include sheath/core fibers having the following polymer combinations: polyethylene/polypropylene, polyethylvinyl acetate/polypropylene, polyethylene/polyester, polypropylene/polyester, copolyester/polyester, and the like. Particularly suitable bicomponent thermoplastic fibers for use herein are those having a polypropylene or polyester core, and a lower melting copolyester, polyethylvinyl acetate or polyethylene sheath (e.g., those available from Danaklon a/s, Chisso Corp., and CELBOND®, available from Hercules). These bicomponent fibers can be concentric or eccentric. As used herein, the terms "concentric" and "eccentric" refer to whether the sheath has a thickness that is even, or uneven, through the cross-sectional area of the bicomponent fiber. Eccentric bicomponent fibers can be desirable in providing more compressive strength at lower fiber thicknesses. The absorbent layer may also comprise a HIPE-derived hydrophilic, polymeric foam. Such foams and methods for their preparation are described in U.S. Pat. 5,550,167 (DesMarais), issued Aug. 27, 1996; and in U.S. Pat. 5,563,179 (Stone et al.), filed Jan. 10, 1995.

The absorbent layer should also preferably be capable of retaining absorbed material under typical in-use pressures to avoid "squeeze-out" of absorbed soil, cleaning solution, etc. To achieve desired total fluid capacities, it will be preferred to include in the absorbent layer a material having a relatively high capacity (in terms of grams of fluid per gram of absorbent material). Therefore, in another preferred embodiment, the absorbent cleaning pads comprise a superabsorbent material. As used herein, the term "superabsorbent material" means any absorbent material having a g/g capacity for water of at least about 15 g/g, when measured under a confining pressure of 0.3 psi (2 kPa). Because a majority of the cleaning fluids useful with the present invention are aqueous based, it is preferred that the superabsorbent materials have a relatively high g/g capacity for water or water-based fluids. As such, absorbent cleaning pads comprising superabsorbent materials have a synergistic effect when used in combination with the cleaning compositions of the present invention, since they are effectively removing water or water-based solutions from the floor thereby mitigating known side effects which water has on wood. Superabsorbent materials useful in the present invention include a variety of water-insoluble, but water-swellable (gelling) polymers capable of absorbing large quantities of fluids. Such polymeric materials are also commonly referred to as "hydrocolloids", and can include polysaccharides such as carboxymethyl starch, carboxymethyl cellulose, and hydroxypropyl cellulose; nonionic types such as polyvinyl alcohol, and polyvinyl ethers; cationic types such as polyvinyl pyridine, polyvinyl morpholinione, and N,N-dimethylaminoethyl or N,N-diethylaminopropyl acrylates and methacrylates, and the respective quaternary salts thereof. Typically, superabsorbent gelling polymers useful in the present invention have a multiplicity of anionic functional groups, such as sulfonic acid, and more typically carboxy, groups. Most preferred polymer materials for use in making the superabsorbent gelling polymers are slightly network crosslinked polymers of partially neutralized polyacrylic acids and starch derivatives thereof. Most preferably, the hydrogel-forming absorbent polymers comprise from about 50 to about 95%, preferably about 75%, neutralized, slightly network crosslinked, polyacrylic acid (i.e. poly (sodium acrylate/acrylic acid)). Network crosslinking renders the polymer substantially water-insoluble and, in part, determines the absorptive capacity and extractable polymer content characteristics of the superabsorbent gelling polymers. Processes for network crosslinking these polymers and typical network crosslinking agents are described in greater detail in U.S. Pat. No. 4,076,663. Superabsorbent polymers are also beneficial when used in combination with the compositions of the present invention because they help keep the floor side of the pad free of water, and significantly enhance the water or aqueous chemistry capacity of the absorbent disposable cleaning pad. Additionally, the superabsorbent polymer ensures that solution removed from the pad remains locked in the pad, thus significantly improving drying time relative to all other cleaning systems (i.e., conventional cleaning systems, pre-moistened pads and disposable absorbent pads lacking the superabsorbent polymer). Such pads are disclosed in U.S. Pat. Nos. 6,048,123, 6,003,191, 5,960,508, 6,101,661, and 6,601,261, U.S. Patent Application No. 2002/0166573, U.S. Patent Application No. 2002/0168216, U.S. Patent Application 2003/0034050, U.S. Patent Application 2003/0095826, U.S. Patent Application 2003/0126708, U.S. Patent Application 2003/0126709, U.S. Patent Application 2003/0126710, U.S. Patent Application 2003/0133740.

The optional, but preferred, scrubbing layer is the portion of the cleaning pad that contacts the soiled surface during cleaning. As such, materials useful as the scrubbing layer must be sufficiently durable that the layer will retain its integrity during the cleaning process. In addition, when the cleaning pad is used in combination with a solution, the scrubbing layer must be capable of absorbing liquids and soils, and relinquishing those liquids and soils to the absorbent layer. This will ensure that the scrubbing layer will continually be able to remove additional material from the surface being cleaned. Whether the implement is used with a cleaning solution (i.e., in the wet state) or without cleaning solution (i.e., in the dry state), the scrubbing layer will, in addition to removing particulate matter, facilitate other functions, such as polishing, dusting, and buffing the surface being cleaned. The scrubbing layer can be a monolayer, or a multi-layer structure one or more of whose layers may be slitted to faciliate the scrubbing of the soiled surface and the uptake of particulate matter. This scrubbing layer, as it passes over the soiled surface, interacts with the soil (and cleaning solution when used), loosening and emulsifying tough soils and permitting them to pass freely into the absorbent layer of the pad. The scrubbing layer preferably contains openings (e.g., slits) that provide an easy avenue for larger particulate soil to move freely in and become entrapped within the absorbent layer of the pad. Low density structures are preferred for use as the scrubbing layer, to facilitate transport of particulate matter to the pad's absorbent layer. In order to provide desired integrity, materials particularly suitable for the scrubbing layer include synthetics such as polyolefins (e.g., polyethylene and polypropylene), polyesters, polyamides, synthetic cellulosics (e.g., Rayon®), and blends thereof. Such synthetic materials may be manufactured using known process such as carded, spunbond, meltblown, airlaid, needlepunched and the like.

The cleaning pads can optionally have an attachment layer that allows the pad to be connected to an implement's handle or the mop head in preferred implements. The attachment layer will be necessary in those embodiments where the absorbent layer is not suitable for attaching the pad to the mop head of the handle. The attachment layer may also function as a means to prevent fluid flow through the top surface (i.e., the handle-contacting surface) of the cleaning pad, and may further provide enhanced integrity of the pad. As with the scrubbing and absorbent layers, the attachment layer may consist of a mono-layer or a multi-layer structure, so long as it meets the above requirements. In a preferred embodiment of the present invention, the attachment layer will comprise a surface which is capable of being mechanically attached to the handle's support head by use of known hook and loop technology. In such an embodiment, the attachment layer will comprise at least one surface which is mechanically attachable to hooks that are permanently affixed to the bottom surface of the handle's support head. To achieve the desired fluid imperviousness and attachability, it is preferred that a laminated structure comprising, e.g., a meltblown film and fibrous, nonwoven structure be utilized. In a preferred embodiment, the attachment layer is a tri-layered material having a layer of meltblown polypropylene film located between two layers of spun-bonded polypropylene.

These disposable pads are advantageous in that they not only loosen dirt, but also absorb more of the dirty solution as compared to conventional cleaning tools or pre-moistened wipes. As a result, surfaces are left with reduced residue and dry faster. As such, these systems are the best suited for the cleaning and polishing of wood flooring using aqueous chemistry. The pads can be used as stand-alone products or in combination with an implement comprising a handle, particularly for the cleaning of floor surfaces.

Pre-moistened wipes—The aqueous cleaning compositions of the invention can be incorporated into a nonwoven substrate to create a pre-moistened wipe. The substrate herein can be formed from any set of fibers known in the art, natural or synthetic. Examples of useful suitable fiber types include pulp, Tencel® Rayon, Lenzing AG Rayon®, microdenier Rayon®, and Lyocell®, polyethylene, polypropylene, polyester, and mixtures thereof. The fibers can be produced via in method known in the art such as air laid, wet laying, metblown, spunbond, carding, spunlacing, needle punching thru-air processing, and the like. The nonwoven substrate can be a monolayered wipe or more preferably be composed of a number of layers bonded together the form a laminate. If the nonwoven is a monolayered substrate, it is preferred that it comprise both hydrophilic (cellulose or cellulose-derived, including pulp, Rayon® and Lyocell® and mixtures thereof) and hydrophobic fibers (synthetic, including polyethylene, polypropylene, polyester, and mixtures thereof) in a ratio of from about 1:5 to about 10:1, more preferably from about 1:3 to about 5:1, still more preferably from about 1:2 to about 3:1, and most preferably from about 1:1 to about 3:1. The face of the wipe facing the floor is optionally textured or otherwise macroscopically three-dimensional. Monolayered wipes preferably have a basis weight of from about 50 grams per square meter ($gm^{-2}$) to about 200 $gm^{-2}$, more preferably from about 60 $gm^{-2}$ to about 150 $gm^{-2}$, most preferably from about 70 $gm^{-2}$ 110 $gm^{-2}$. The load factor, i.e., the level of solution added to the dry nonwoven substrate on a gram per gram basis, is preferably from about 2:1 to about 6:1, more preferably from about 2.5:1 to about 5.5:1, most preferably from about 3:1 to about 5:1. Monolayered wipes intended for use on wood furniture will have a lower basis weight and load factor. The basis weight is preferably from about 25 $gm^{-2}$ to about 100 $gm^{-2}$, more preferably from about 35 $gm^{-2}$ to about 80 $gm^{-2}$ and most preferably from about 40 $gm^{-2}$ to about 70 $gm^{-2}$. The load factor for furniture wipes employing the compositions of the invention is from about 1:1 to about 4:1, more preferably from about 1.2:1 to about 3:1, most preferably from about 1.5:1 to about 2.5:1.

The choice of substrate chemical composition will depend on the desired solution release properties from the pre-moistened wipe. Hydrophilic fibers absorb more solution than hydrophobic fibers at a given basis weight and load factor, and this results in a lower solution release profile on floors. Lower release of aqueous cleaning composition can be advantageous since it limits floor wetness, which in turn helps drying. Reduced floor wetness can also be achieved by controlling load factor. Net, the skilled artisan will appreciate that careful manipulation of nonwoven substrate parameters in the development of a pre-moistened wipe comprising the compositions of the invention can allow the dialing-in of controlled wetness on wood floors and this provides an advantage over aqueous cleaning solutions delivered by conventional implements (sponges, cellulosic strips, etc.). Such an advantage can be magnified when the nonwoven substrate of choice is a laminate of materials.

In a preferred embodiment, the pre-moistened wipe is a laminate comprising an outer scrub or buff layer, inner absorptive layer which functions as a liquid reservoir and, optionally, a protective back layer, which optionally functions as an attachment layer to a handle. The dry laminate wipe is wetted with the compositions of the invention at a load factor of from about 4:1 to about 10:1, more preferably from about 4.5:1 to about 8:1, most preferably from about 5:1 to about 7:1. The outer scrub or buff layer is a nonwoven substrate having a basis weight of from about 15 $gm^{-2}$ to about 100 $gm^{-2}$, more preferably from about 20 $gm^{-2}$ to about 80 $gm^{-2}$, most preferably from 25 $gm^{-2}$ to about 70 $gm^{-2}$. The outer layer preferably has a structure that is macroscopically three-dimensional, and optionally includes a scrim material. The outer scrub layer optionally comprises from about 0-50% by weight of hydrophilic fibers, and from about 50% to 100% by weight of hydrophobic fibers. The inner absorptive layer preferably has a basis weight of from about 70 $gm^{-2}$ to about 300 $gM^{-2}$, more preferably from about 80 $gm^{-2}$ to about 200 $gm^{-2}$, most preferably from about 90 $g^{-2}$ to about 160 $gm^{-2}$. It is preferably composed of from about 70% to about 90% wood pulp fibers or other cellulosic materials and about 10% to about 30% binders. The inner absorptive layer fibers can be of any denier, and have any fiber density. Particularly if the inner absorptive layer is air-laid, fiber density can be fine-tuned, thereby controlling the amount of aqueous cleaning composition that residing in the inner absorptive layer. By manipulating the fiber density in the inner absorptive layer, material chemical composition and process, and basis weight of the outer scrub or buff layer, the skilled artisan can control wetness delivered on floors via mopping action. The optional back layer is preferably a low basis weight (preferably less than about 50 $gm^{-2}$) polyethylene or polypropylene sheet that acts can act as an impermeable film preventing loss of solution from the inner absorptive layer or as an attachment layer to the mop head. An example of a commercially available cleaning pre-moistened wipe to be used in combination with the compositions of the present invention is Swiffer Wet®, manufactured and marketed by the Procter & Gamble Company.

Process for cleaning a surface—In a preferred embodiment, the present invention encompasses a process of cleaning a surface, preferably a hard surface, comprising the step of contacting, preferably wiping, said surface with an aqueous composition of the present invention. In another highly preferred embodiment, the composition is sprayed onto the surface, and consequently wiped using any cleaning tool or cleaning implement comprising a cleaning tool as described above. If desired, the cleaned surface may be wiped to dryness using any type of woven or nonwoven wipe, optionally in combination with a cleaning implement.

Test Methodologies—Bruce engineered wood ABC 201®, dark brown color with Duraluster plus (urethane) finish is used in the testing. Boxes of floor tiles are purchased from Lowe's Home Improvement stores, Cincinnati, USA, and the length of the wooden planks is cut to create test tiles that are 0.375 inches (1 cm) thick, 3 inches (7.62 cm) wide and 12 inches (30.5 cm) long. Black ceramic tiles used in these experiments are CeramiCraft 30 cm×30 cm with matt finish, Made in France, by Marazzi, purchased from the Carpetland, Woodlawn, Ohio. Armstrong® Sure & Easy, pattern # 27770 (30 cm×30 cm) vinyl tiles are purchased from Lowe's Home Improvement stores in Cincinnati, USA, and are used in the experiments. All cleaning tests are run in triplicate to ensure good consistency and reproducibility of results.

Two types of cleaning tests are run: soiled and unsoiled. The soil used in the testing comprises about 80% particulate inorganic matter and about 20% lightly polymerized oil. The soil is suspended in a low boiling solvent mix and rolled onto the clean test tiles. When dry, the tiles contain approximately 300 mg soil per square foot. Unsoiled tests are run on test surface that are clean and devoid of any treatments other than those that may have been incorporated by the tile manufacturer.

For each cleaning test, aqueous cleaning compositions are applied to the test tile and the tile is then cleaned with a sponge, pre-moistened wipe or disposable cleaning pad comprising super absorbent polymer. Drying time is recorded as the time needed for all solution to be visually evaporated from the test tiles. Visual grades for streaks and haze are recorded after the first cleaning cycle. Within a cleaning test, each set of tiles is cleaned three times (three cleaning cycles, whereby the test tile is completely wetted with the cleaning composition during each cleaning cycle) in succession, and gloss readings are recorded prior to any testing and following the completion of the third cleaning cycle. Gloss is measured using a 'BYK Gardner micro-TRI-gloss®' gloss-meter using the 60° angle setting. The gloss-meter is manufactured by BYK-Gardner, and is available under catalog number is GB-4520. The gloss of each tile is analytically measured at six different locations on the tile, and the readings averaged. The percent gloss is then calculated as: % gloss retention=(Gloss reading of tile after treatment÷Gloss reading of tile prior to treatment)*100%. Visual grading is conducted by an expert panelist using a 0-4 scale, where "0" represents a perfectly clean tile and "4" represents a highly soiled tile. Grades in between 0-4 provide an estimate of the cleaning ability of the test compositions with lower number grades suggesting improved performance.

EXAMPLES

The following non-limiting examples illustrate the benefits of the compositions of the present invention. The cleaning compositions are used in all of the illustrative technical tests.

In one set of examples, the cleaning compositions are used in conjunction with conventional sponges. Sponges with dimensions 14 cm×9 cm×2.5 cm purchased from VWR Scientific, catalog No. 58540-047, cut to size by cutting each sponge in thirds along the width of the sponge, washed in a conventional washing machine with detergent and then washed in plain water in a washing machine 3 times so as to strip the sponge finishes. The sponges are then allowed to dry in a working fume hood for 48 hours. The dimensions of the dry sponges after air-drying are about 9 cm×4.5 cm×2.5 cm. Dry test sponges are weighed (5±1 grams). In each case, distilled water is then added at a load factor of 2 grams water per gram sponge so as moisten the sponge. Using a disposable pipette, then the tile (1 sq. ft) is dosed with 2 ml of test product. The damp sponges are then placed at one end of the test tile and manually moved back and forth across the length of the tile in cleaning motions until it is completely wetted.

In another set of examples, the cleaning compositions are impregnated onto a Swiffer Wet® dry wipe at a loading of 45 grams of aqueous cleaning per wipe. The pre-moistened Swiffer Wet pad is then cut into thirds along the width such that the dimensions of the test wipe are approximately 10 cm×9 cm. The pre-moistened pads are then placed at one end of the test tile and manually moved back and forth across the length of the tile in cleaning motions until it is completely wetted.

In a third set of examples, the use of absorbent pads comprising super absorbent polymers in conjunction with the aqueous compositions of the invention Pads used is illustrated. The pads employed are those commercially available in the US as "Swiffer WETJET®". For the purposes of the test the pad is cut down to a dimension of 11.5×14.5 cm along the width of the pad in order to scale it down so it can effectively be used to clean the tile which has dimensions of 20 cm×20 cm×1 cm as described above. After cutting the edges, the pad is sealed with two-sided tape to prevent super-absorbent polymer from leaching out. The pad is then attached to a handle with a mop head. The implement head can be made using an implement such as that sold as "Swiffer®", taking the head portion only and cutting it down to 10.5×11.5 cm (thus creating a mini implement to go with the reduced size pads used in the experiments). The pad can be attached with tape onto the Swiffer® mini implement or with Velcro. The mini pad is then primed with 1 ml of the test product prior to using on the tile, which is dosed with 1 ml test product per ½ square foot area.

| Compositions | A | B | C | D | E | F | G | H |
|---|---|---|---|---|---|---|---|---|
| C10 Alkyl Polyglucoside | 0.03% | 0.03% | 0.03% | 0.03% | 0.03% | 0.03% | 0.03% | 0.03% |
| Propylene Glycol n-Butyl Ether | 1.00% | 1.00% | 1.00% | 1.00% | 1.00% | 1.00% | 1.00% | 1.00% |
| Ethanol | 3.00% | 3.00% | 3.00% | 3.00% | 3.00% | 3.00% | 3.00% | 3.00% |
| Copolymer* | — | 0.50% | 0.75% | 1.00% | — | 0.50% | — | — |
| Modified polyethyleneimine** | 0.02% | 0.02% | 0.02% | 0.02% | 0.02% | 0.02% | 0.02% | 0.02% |
| Chitosan polymer*** | — | — | — | — | 0.02% | 0.02% | 0.25% | — |
| Chitosan polymer (2)**** | — | — | — | — | — | — | — | 0.25% |
| Perfume | 0.06% | 0.06% | 0.06% | 0.06% | 0.06% | 0.06% | 0.06% | 0.06% |

*Alcosperse 747 (Alco Chemical)
**Lupasol SK (BASF Corporation)
***Chitosan (Jiande BioChemical), Mw ~500,000
****'MP 346' from P&G Chemicals produced by reducing molecular weight of Jiande materials to ~10,000.

Results—The effect of copolymer on drying times on wood is recorded following the first cleaning application. Percent gloss retention is also measured following three cleaning cycles. Data are obtained at low and high relative humidity (RH) conditions.

| | Drying Time (seconds) | | | | Gloss Retention (%) | | | |
|---|---|---|---|---|---|---|---|---|
| | Relative Humidity | | | | | | | |
| | RH = 34% | | RH = 67% | | RH = 34% | | RH = 67% | |
| Composition | A | B | A | B | A | B | A | B |
| Sponge | 399 | 342 | 805 | 547 | 101.1% | 109.9% | 99.8% | 103.3% |
| Swiffer Wet | 321 | 286 | 540 | 315 | 102.4% | 104.8% | 99.8% | 102.9% |
| Wet Jet | 403 | 252 | 683 | 447 | 100.8% | 105.8% | 99.5% | 103.8% |

Composition B consistently shows gloss enhancement benefits vs. untreated tiles and tiles treated with composition A. Composition B also shows faster drying times than composition A. The benefits for composition B are observed for all three cleaning implements (sponges, Swiffer Wet pre-moistened pads and Swiffer Wet Jet disposable absorbent pads with superabsorbent polymer) at both low and high humidity conditions.

The impact of polymer level on drying time after the first cleaning cycle and % gloss retention after the third cleaning cycle are studied as a function of copolymer level (0.25%-1.0%) in the context of disposable absorbent pads comprising superabsorbent polymer:

| Composition | A | B | C | D |
|---|---|---|---|---|
| Drying Time (seconds) | 403 | 252 | 237 | 250 |
| Gloss Retention (%) | 100.8% | 105.8% | 113.1% | 111.2% |

At all copolymer levels examined, drying time is shortened and gloss enhancement benefits are realized. The drying time is effectively independent of the concentration of copolymer over the range evaluated.

The filming/streaking and drying time impact of the styrene-acrylate copolymer and chitosan polymer on a single cleaning cycle are evaluated on different surface types in the context of disposable absorbent pads comprising superabsorbent polymer:

| Expert Grades (0-4) & Dry Time, Soiled Tiles | | | | | | |
|---|---|---|---|---|---|---|
| Surface Type | Streaks | 60% RH Haze | Dry time (seconds) | Streaks | 35% RH Haze | Dry time (seconds) |
| Wood | | | | | | |
| A | 2.75 | 2.5 | 417 | 2.25 | 1.5 | 397 |
| B | 2.5 | 1.75 | 318 | 1.25 | 1 | 244 |
| E | 3 | 2 | 362 | 2 | 2 | 175 |
| F | 2.5 | 2 | 320 | 1.5 | 1 | 190 |
| Black Ceramic | | | | | | |
| A | 3 | 2.5 | 374 | 1.5 | 1.25 | 365 |
| B | 2.5 | 2.5 | 227 | 1.5 | 1.25 | 228 |
| E | 3.5 | 2.5 | 273 | 2.5 | 2 | 173 |
| F | 2.5 | 2.5 | 252 | 1.25 | 1.25 | 160 |
| White Vinyl | | | | | | |
| A | 2.5 | N/A | 560 | 2 | N/A | 266 |
| B | 2 | N/A | 437 | 1.25 | N/A | 261 |
| E | 3 | N/A | 498 | 1.5 | N/A | 190 |
| F | 2.5 | N/A | 340 | 1.5 | N/A | 254 |

The data again illustrate the benefits of the invention. Drying times are shortened on all surfaces tested using the compositions of the invention (B, E & F vs. A). Additionally, the data illustrate the ability to achieve fast drying time with low (0.02%) levels of chitosan. Finally, the data illustrate the ability to combine polymer technologies and still achieve cleaning and drying time benefits, especially on wood surfaces.

The role of chitosan and chitosan molecular weight are evaluated with respect to drying time and gloss enhancement on wood using a single cycle. In the test, product A provided a gloss index of 100 (control) and an average drying time of 332 seconds. Product G (with Jiande chitosan level at 0.25%) provided a drying time of 303 seconds and a gloss index of 98.4. Product H provided a drying time of 259 seconds and a gloss index of 101.3. The data illustrate the gloss and drying time benefits of the lower molecular weight chitosan.

The self-strippability of the coating formed by copolymer in composition B is illustrated by sequentially cleaning unsoiled Bruce engineered wood three times with composition B, recording percent gloss retention, and then recleaning the same tile with composition A and once again recording percent gloss retention.

| | Initial Untreated | 1 Cycle B | 3 Cycles B | 1 Cycle A |
|---|---|---|---|---|
| % Gloss Retention | 100.0% | 103.9% | 105.2% | 99.8% |

Results show that gloss increases 5.2% after three sequential cleanings with composition B and that the gloss enhancement is completely removed by a single cleaning with composition A. That is, the copolymer coating is completely stripped off in a single cleaning cycle.

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An aqueous floor cleaning composition wherein said composition comprises:

a) at least one polymer selected from:

1. a copolymer comprising a first and a second set of monomer units, wherein said first set of monomer units is selected from the group consisting of acrylate, substituted acrylate monomers, and mixtures thereof, and wherein said second set of monomers is selected from the group consisting of styrene, substituted styrene monomers, and mixtures thereof, wherein said copolymer has a weight ratio of the first set of monomers to the second set of monomers from about 2:1 to about 1:2, and wherein said copolymer has an average molecular weight of less than about 20,000, and wherein said copolymer is present in the composition at a level of about 0.01% to about 1.0% by weight of said composition;
2. chitosan having an average molecular weight from about 5,000 to about 500,000, wherein said chitosan is present in the composition at a level of about 0.01% to about 1.0% by weight of said composition; and
3. mixtures thereof; and b) from about 0.005% to about 0.5%, by weight of said composition, of one or more surfactants;

wherein the aqueous floor cleaning composition has a pH of about 6.5 to about 11.

2. The aqueous floor cleaning composition according to claim 1, wherein the polymer is a copolymer comprising a first and a second set of monomer units, wherein said first set of monomer units is selected from the group consisting of acrylate, substituted acrylate monomers, and mixtures thereof, and wherein said second set of monomers is selected from the group consisting of styrene, substituted styrene monomers, and mixtures thereof, wherein said copolymer has a weight ratio of the first set of monomers to the second set of monomers from about 2:1 to about 1:2, and wherein said copolymer has an average molecular weight of less than about 20,000, and wherein said copolymer is present in the composition at a level of about 0.01% to about 1.0% by weight of said composition.

3. The aqueous floor cleaning composition according to claim 1, wherein said average molecular weight of said copolymer is less than about 15,000.

4. The aqueous floor cleaning composition according to claim 1, wherein said weight ratio of the first set of monomers to the second set of monomers in said copolymer is about 1:1, and wherein said copolymer has an average molecular weight of about 3,000.

5. The aqueous floor cleaning composition according to claim 1, wherein said polymer is chitosan having an average molecular weight of from about 5,000 to about 100,000 and wherein said chitosan is present in said composition at a level of about 0.01% to about 1.0% by weight of said composition.

6. The aqueous floor cleaning composition according to claim 1, wherein said composition is self-strippable.

7. The aqueous floor cleaning composition according to claim 1, wherein the pH of said composition is from about 7.0 to about 9.5.

8. The aqueous floor cleaning composition according to claim 1, wherein the level of surfactants is from about 0.01% to about 0.20%.

9. The aqueous floor cleaning composition according to claim 1, wherein the at least one surfactant comprises a non-ionic surfactant selected from the group consisting of alkyl polyglucosides, amine oxides, alkyl ethoxylates, alkyl ethoxy propoxylates, and mixtures thereof.

10. The aqueous floor cleaning composition according to claim 9, wherein said non-ionic surfactant comprises an alkyl polyglucoside, having a hydrophobic tail comprising from about 8 carbon atoms to about 16 carbon atoms and an average number of glucoside units of from about 1.2 to about 1.8.

11. The aqueous floor cleaning composition according to claim 1, further comprising from about 0.25% to about 10% of one or more solvents.

12. The aqueous floor cleaning composition according to claim 11, wherein said solvent comprises at least one glycol ether selected from the group consisting of propylene glycol n-propyl ether, propylene glycol n-butyl ether, ethylene glycol n-hexyl ether, diethylene glycol n-hexyl ether, and mixtures thereof.

13. The aqueous floor cleaning composition according to claim 1, further comprising a polymer selected from the group consisting of xanthan gum, guar gum, modified polyethylene imine, polystyrene sulfonate, polyvinyl pyffolidone and mixtures thereof.

14. A cleaning kit comprising an absorbent cleaning pad, said pad optionally comprising a superabsorbent material, and a reservoir containing the cleaning composition according to claim 1.

15. The cleaning kit according to claim 14, wherein said kit further comprises a cleaning implement, said cleaning implement comprising a handle and a mop head, and optionally a liquid delivery system.

16. A pre-moistened cleaning pad for cleaning a wooden floor surface, said pad comprising an absorbent layer impregnated with the composition according to claim 1.

17. A method of cleaning a wooden floor surface comprising the step of: contacting said wooden floor surface with the composition of claim 1.

18. The method of claim 17, further comprising the step of: wiping said wooden floor with a cleaning implement.

19. The method of claim 18, wherein said cleaning implement comprises a disposable cleaning pad for absorbing said cleaning composition.

20. A method of cleaning a wooden floor surface, comprising the step of: wiping said floor with a pre-moistened wipe according to claim 16.

21. A method of cleaning a floor comprising:

contacting a floor with an aqueous cleaning composition which comprises at least one polymer selected from:

1. a copolymer comprising a first and a second set of monomer units, said first set of monomer units being selected from the group consisting of acrylate, substituted acrylate monomers, and mixtures thereof, and said second set of monomers being selected from the group consisting of styrene, substituted styrene monomers, and mixtures thereof, said copolymer having a weight ratio of the first set of monomers to the second set of monomers from about 2:1 to about 1:2, said copolymer having an average molecular weight of less than about 20,000; and
2. chitosan having an average molecular weight from about 5,000 to about 500,000, in an aqueous floor cleaning composition, for enhancing the gloss of floor surfaces, wherein the cleaning composition has a pH of about 6.5 to about 11.

22. The method according to claim 21, wherein the floor comprises a wooden floor surface.

23. The method according to claim 21, wherein the cleaning composition has a pH of about 7.0 to about 9.5.

* * * * *